US009822755B2

(12) United States Patent
Toyoshima et al.

(10) Patent No.: US 9,822,755 B2
(45) Date of Patent: Nov. 21, 2017

(54) GLOW PLUG DIAGNOSIS METHOD AND VEHICLE GLOW PLUG DRIVE CONTROL APPARATUS

(71) Applicant: Bosch Corporation, Tokyo (JP)

(72) Inventors: Yasuo Toyoshima, Saitama (JP); Shuichi Tsukahara, Saitama (JP); Tomohiro Nakamura, Saitama (JP); Yutaka Tanaka, Saitama (JP)

(73) Assignee: Bosch Corporation, Tokyo (JP)

( * ) Notice: Subject to any disclaimer, the term of this patent is extended or adjusted under 35 U.S.C. 154(b) by 277 days.

(21) Appl. No.: 14/652,502

(22) PCT Filed: Nov. 18, 2013

(86) PCT No.: PCT/JP2013/080983
§ 371 (c)(1),
(2) Date: Jun. 16, 2015

(87) PCT Pub. No.: WO2014/103554
PCT Pub. Date: Jul. 3, 2014

(65) Prior Publication Data

US 2016/0195056 A1 Jul. 7, 2016

(30) Foreign Application Priority Data

Dec. 27, 2012 (JP) ..... 2012-283923

(51) Int. Cl.
*F02P 19/02* (2006.01)

(52) U.S. Cl.
CPC ..... *F02P 19/026* (2013.01); *F02P 19/025* (2013.01); *F02P 19/027* (2013.01)

(58) Field of Classification Search
None
See application file for complete search history.

(56) References Cited

U.S. PATENT DOCUMENTS 4,500,775 A * 2/1985 Sangu ..... F02P 19/027 123/145 A
5,144,922 A * 9/1992 Kong ..... F02P 19/025 123/145 A (Continued)

FOREIGN PATENT DOCUMENTS

EP EP 2085607 A1 * 8/2009 ..... F02P 19/025
JP 5726275 2/1982

(Continued)

OTHER PUBLICATIONS

EP 2085607 A1, Dietrich, Aug. 2009, partial translation.*

(Continued)

*Primary Examiner* — Joseph M Pelham
(74) *Attorney, Agent, or Firm* — Michael Best & Friedrich LLP

(57) ABSTRACT

Disclosed is a glow plug diagnosis method of being able to diagnose the aging or fault of a glow plug without being affected by cooling associated with air intake/exhaust or fuel injection, the method including: a step (S102) of energizing a glow plug 1 in a predetermined manner when a key switch 11 of a vehicle is turned on; and a step (S106) of measuring the resistance value of the glow plug 1 when the energization of the glow plug 1 is started, and the resistance value of the glow plug when the energization of the glow plug 1 is started and then a change in the resistance value is saturated, and of calculating a change in the resistance value over time as a resistance value gradient, in which it is determined that the glow plug 1 is normal when the resistance value gradient exceeds a predetermined first gradient reference value a, and it is determined that the glow plug 1 is faulty, and a warning lamp or the like is lighted when the resistance value gradient is less than a predetermined second gradient reference value b (S112 and S118).

12 Claims, 5 Drawing Sheets

(56) References Cited

U.S. PATENT DOCUMENTS

| | | | | |
|---|---|---|---|---|
| 8,217,310 | B2 * | 7/2012 | Sakurai | F02P 19/025 123/179.6 |
| 8,227,726 | B2 * | 7/2012 | Funaki | F23Q 7/001 219/260 |
| 8,976,505 | B2 * | 3/2015 | Kernwein | F02P 19/025 361/264 |
| 2009/0037120 | A1 * | 2/2009 | Hiramatsu | F02P 19/025 702/34 |
| 2010/0161150 | A1 * | 6/2010 | Sakurai | F02P 19/027 700/296 |
| 2010/0286895 | A1 * | 11/2010 | Bauer | F02P 19/027 701/113 |
| 2011/0303649 | A1 * | 12/2011 | Sakurai | F02D 41/2432 219/263 |
| 2011/0303650 | A1 * | 12/2011 | Sakurai | F02P 19/025 219/263 |
| 2013/0233272 | A1 * | 9/2013 | Sackmann | H05B 1/0236 123/198 R |
| 2014/0216384 | A1 * | 8/2014 | Tanaka | F02P 19/027 123/179.6 |

FOREIGN PATENT DOCUMENTS

| | | |
|---|---|---|
| JP | 58172472 | 11/1983 |
| JP | 11182400 | 7/1999 |
| JP | 2002276524 | 9/2002 |
| JP | 200831979 | 2/2008 |
| JP | 2009036092 A | 2/2009 |
| JP | 2011185128 | 9/2011 |

OTHER PUBLICATIONS

International Search Report for Application No. PCT/JP2013/080983 dated Dec. 24, 2013 (English Translation, 2 pages).

* cited by examiner

Fig. 2

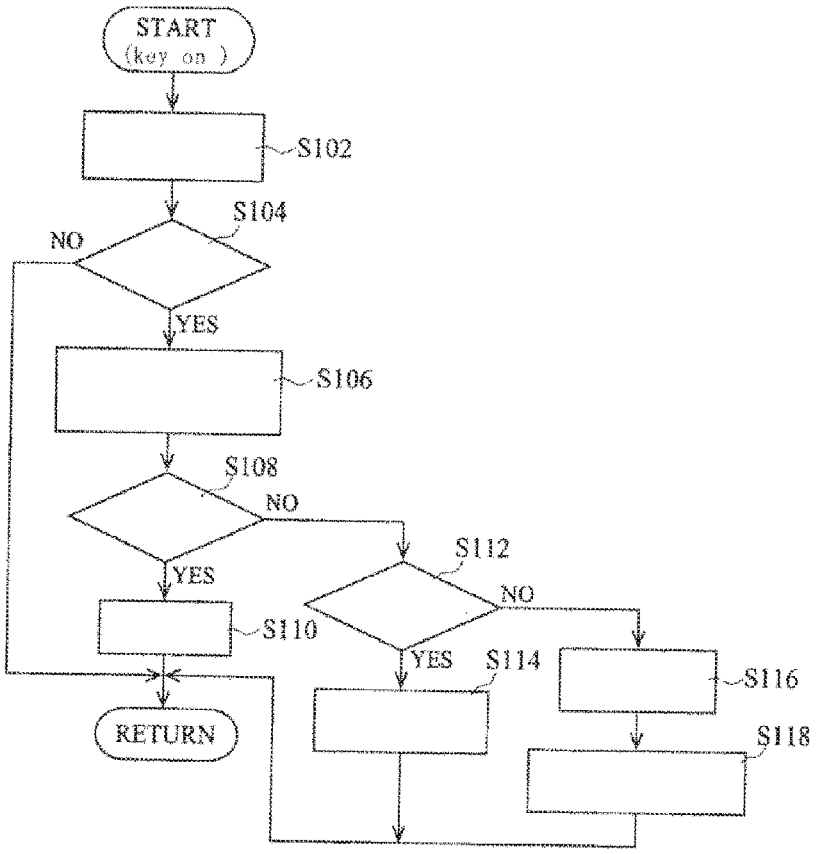

S102: START-UP ENERGIZATION

S104: CAN DIAGNOSIS BE PERFORMED?

S106: ACQUIRE RESISTANCE VALUE GRADIENT DATA AT START-UP

S108: IS GRADIENT GREATER THAN OR EQUAL TO FIRST GRADIENT REFERENCE VALUE a?

S110: DETERMINES THAT GLOW PLUG IS NORMAL

S112: IS GRADIENT GREATER THAN OR EQUAL TO SECOND GRADIENT REFERENCE VALUE b, AND LESS THAN FIRST GRADIENT REFERENCE VALUE a?

S114: CALCULATE CORRECTION COEFFICIENT

S116: STORE RESISTANCE VALUE GRADIENT DATA

S118: LIGHT MIL LAMP

Fig. 3

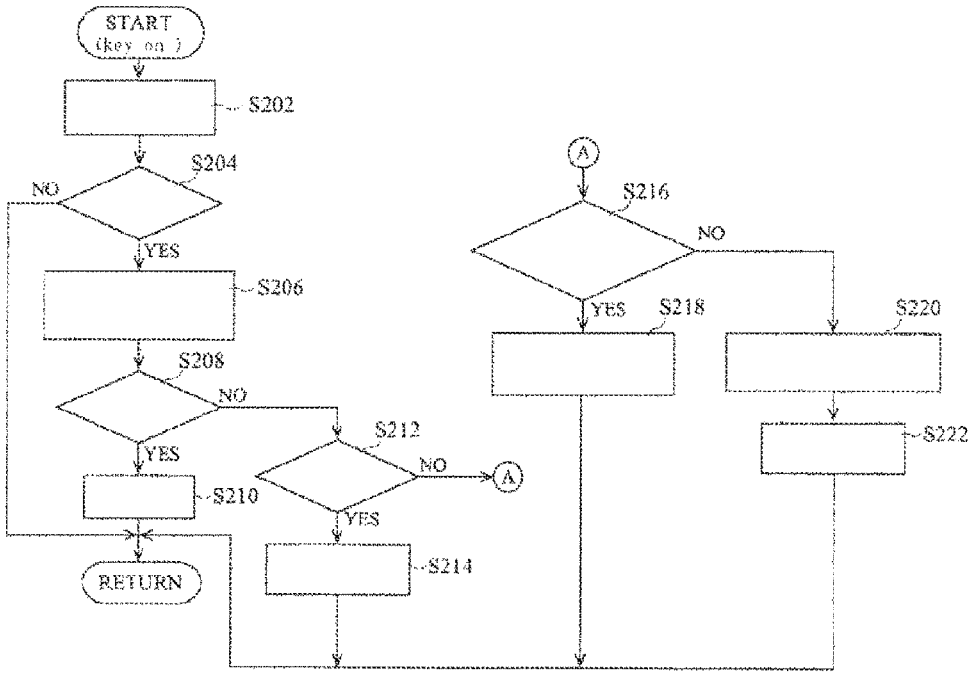

S202: START-UP ENERGIZATION

S204: CAN DIAGNOSIS BE PERFORMED?

S206: ACQUIRE RESISTANCE VALUE GRADIENT DATA AT START-UP

S208: IS GRADIENT GREATER THAN OR EQUAL TO FIRST GRADIENT REFERENCE VALUE a?

S210: DETERMINES THAT GLOW PLUG IS NORMAL

S212: IS GRADIENT GREATER THAN OR EQUAL TO SECOND GRADIENT REFERENCE VALUE b, AND LESS THAN FIRST GRADIENT REFERENCE VALUE a?

S214: CALCULATE CORRECTION COEFFICIENT

S216: IS THERE PRELIMINARY ERROR DETERMINATION AT KEY-OFF?

S218: CONFIRM THAT THERE IS ERROR AND LIGHT MIL LAMP

S220: STORE PRELIMINARY ERROR DETERMINATION VALUE

S222: CALCULATE CORRECTION COEFFICIENT

Fig. 4

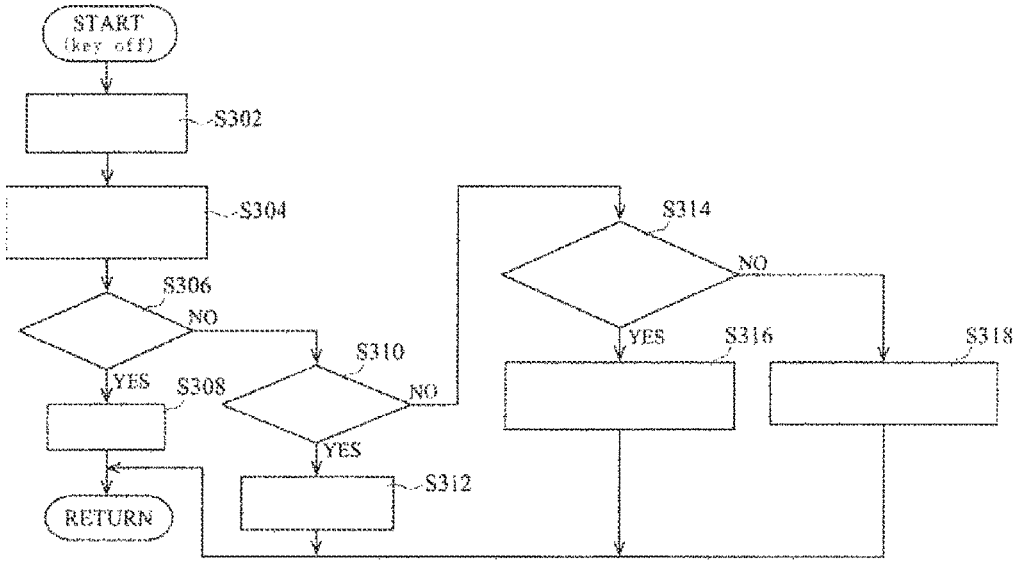

S302: TEST ENERGIZATION

S304: ACQUIRE RESISTANCE VALUE WHEN TEST ENERGIZATION IS COMPLETED

S306: IS RESISTANCE VALUE LESS THAN OR EQUAL TO FIRST REFERENCE RESISTANCE VALUE c?

S308: DETERMINES THAT GLOW PLUG IS NORMAL

S310: IS RESISTANCE VALUE GREATER THAN FIRST REFERENCE RESISTANCE VALUE c, AND LESS THAN OR EQUAL TO SECOND REFERENCE RESISTANCE VALUE d?

S312: CALCULATE CORRECTION COEFFICIENT

S314: IS THERE PRELIMINARY ERROR DETERMINATION AT KEY-OFF?

S316: CONFIRM THAT THERE IS ERROR AND LIGHT MIL LAMP

S318: STORE PRELIMINARY ERROR DETERMINATION VALUE

GLOW PLUG DIAGNOSIS METHOD AND VEHICLE GLOW PLUG DRIVE CONTROL APPARATUS

BACKGROUND OF THE INVENTION

The present invention relates to a method of diagnosing the aging and fault of a glow plug, particularly, to a method of improving the reliability of diagnostic results.

Since the quality of a glow plug in an internal combustion engine such as a diesel engine considerably affects the startability of the diesel engine or the like, in the related art, various methods and apparatuses for diagnosing the quality, the state of aging of the glow plug have been proposed and put into practice.

For example, JP-A-11-182400 discloses an apparatus that is configured to detect the upstream and downstream voltages of the glow plug, and to be able to determine the open circuit of the glow plug based on a difference in the voltage.

JP-A-2002-276524 discloses an apparatus that is configured to be able to determine the open circuit of the glow plug by comparing the electric potential of a series circuit including the glow plug with a reference electric potential corresponding to the voltage of a power supply.

JP-A-2011-185128 discloses an apparatus that is configured to detect the resistance value of the glow plug multiple times, and to correct a voltage applied to the glow plug based on the detected resistance values.

Meanwhile, in the related art, the apparatuses disclosed in JP-A-11-182400 and JP-A-2002-276524 can detect the open circuit of the glow plug; however, since the apparatuses perform a detection process during operation of the internal combustion engine, cooling associated with air intake/exhaust or fuel injection may cause a change in the resistance value of the glow plug, and thereby, the apparatus cannot accurately detect resistance values and the state of aging of the glow plug, which is a problem.

In the related art, the apparatus disclosed in JP-A-2002-276524 has a problem in that the only correction to the applied voltage contrarily promotes the aging of the glow plug.

SUMMARY OF THE INVENTION

The present invention is made in light of these problems, and an object of the present invention is to provide a glow plug diagnosis method and a vehicle glow plug drive control apparatus that can detect the aging or fault of a glow plug without being affected by cooling associated with air intake/exhaust or fuel injection.

According to a first aspect of the present invention, there is provided a glow plug diagnosis method including: a step of energizing a glow plug in a predetermined manner when a key switch of a vehicle is turned on; and a step of measuring the resistance value of the glow plug when the energization of the glow plug is started, and the resistance value of the glow plug when the energization of the glow plug is started and then a predetermined time elapses, and of calculating a change in the resistance value over time as a resistance value gradient, in which it is determined that the glow plug is normal when the resistance value gradient exceeds a predetermined first gradient reference value.

With this configuration, when the resistance value gradient is less than a predetermined second gradient reference value, it is preferably determined that the glow plug is faulty.

According to a second aspect of the present invention, there is provided a vehicle glow plug drive control apparatus including: a computation control unit configured to control the driving of a glow plug; and an energization drive circuit configured to energize the glow plug in response to the control of the driving of the glow plug executed by the computation control unit, in which, when a key switch of a vehicle is turned on, the computation control unit energizes the glow plug in a predetermined manner, calculates the resistance value of the glow plug when the energization of the glow plug is started, and the resistance value of the glow plug when the energization of the glow plug is started and then a predetermined time elapses, based on a voltage applied to the glow plug and energization current of the glow plug, and calculates a change in the resistance value over time as a resistance value gradient based on the calculated resistance values, and when the resistance value gradient exceeds a predetermined first gradient reference value, the computation control unit determines that the glow plug is normal.

With this configuration, when the resistance value gradient is less than a predetermined second gradient reference value, the computation control unit preferably determines that the glow is faulty.

According to the present invention, it is possible to determine the aging or fault of a glow plug based on the size of a change in a resistance value due to the energization of the glow plug before an engine is started up, or the resistance value of the glow plug immediately after the engine is stopped, and thereby, unlike the related art, it is possible to diagnose the aging or fault of the glow plug without being affected by cooling associated with air intake/exhaust or fuel injection, and it is possible to perform a highly reliable diagnosis.

BRIEF DESCRIPTION OF THE DRAWINGS

FIG. 2 is a subroutine flowchart illustrating the sequence of a process in a first example of a glow plug diagnosis method applied to the glow plug drive control apparatus illustrated in FIG. 1.

FIG. 3 is a subroutine flowchart illustrating the sequence of a process in a second example of the glow plug diagnosis method applied to the glow plug drive control apparatus illustrated in FIG. 1, and illustrating the sequence of the process when a key switch is turned on.

FIG. 4 is a subroutine flowchart illustrating the sequence of a process in the second example of the glow plug diagnosis method applied to the glow plug drive control apparatus illustrated in FIG. 1, and illustrating the sequence of the process when the key switch is turned off.

DETAILED DESCRIPTION

Description of Reference Numerals and Signs

Figure 1:
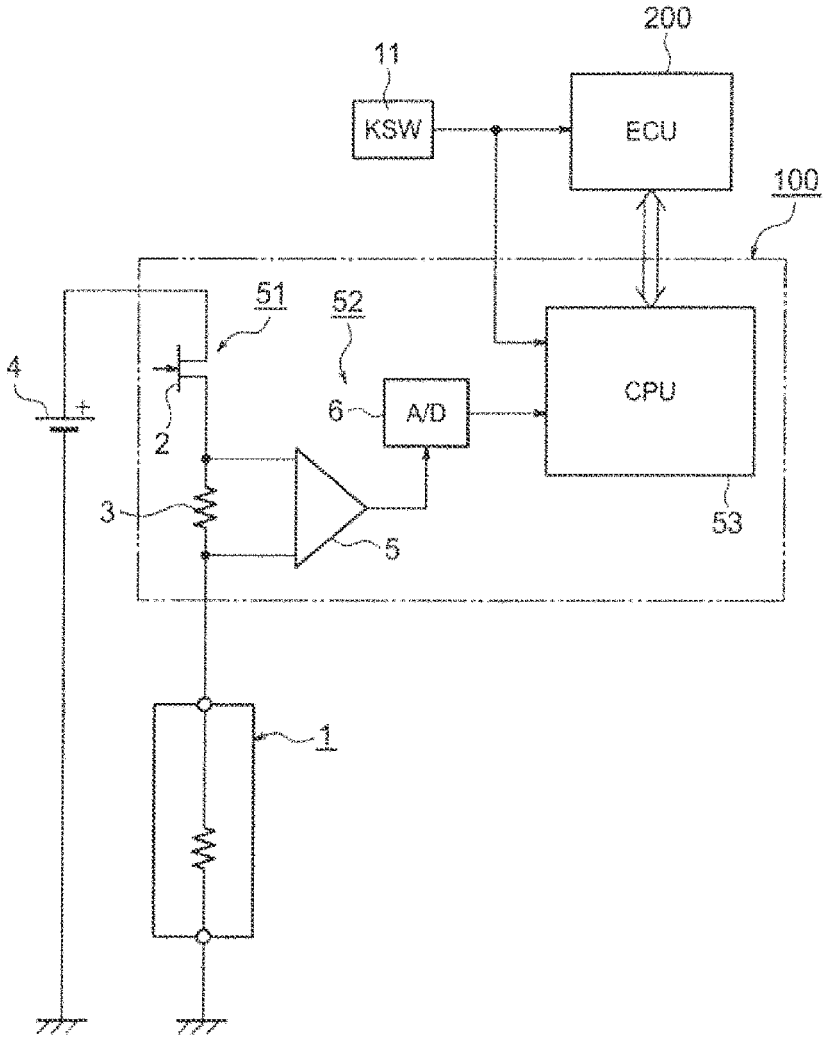
FIG. 1 is a configuration diagram illustrating an example of the configuration of a glow plug drive control apparatus according to an embodiment of the present invention.

1: glow plug
3: shunt resistor
5: computational amplifier
6: analog/digital converter
51: energization drive circuit

52: measurement circuit
53: computation control unit
100: glow plug drive control apparatus
200: electronic engine control unit Hereinafter, an embodiment of the present invention will be described with reference to FIGS. 1 to 6.

Members, disposition, and the like in the following description do not limit the present invention, and can be modified in various forms insofar as the modifications do not depart from the spirit of the present invention.

Initially, a glow plug drive control apparatus (hereinafter, referred to as a "GCU") 100 in the embodiment of the present invention will be described with reference to FIG. 1.

The configuration of the GCU 100 in the present invention is broadly divided into an energization drive circuit 51; a measurement circuit 52; and a computation control unit (represented by "CPU" in FIG. 1) 53.

The energization drive circuit 51 includes an energization control semiconductor element 2 and a shunt resistor 3 as main configurational elements, and is configured to be able to control the energization of a glow plug 1.

That is, first, a MOSFET or the like is used as the energization control semiconductor element 2, a drain of the energization control semiconductor element 2 is connected to a positive pole of a vehicle battery 4, a source thereof is connected to a positive pole of the glow plug 1 via the shunt resistor 3, and a negative pole of the glow plug 1 is connected to the ground. A control signal from the computation control unit 53 is applied to a gate of the energization control semiconductor element 2, and thus, the energization and de-energization of the energization control semiconductor element 2 can be controlled.

In contrast, the measurement circuit 52 includes a computational amplifier 5, and analog/digital converter (represented by "A/D" in FIG. 1) 6 as main configurational elements, and is configured to be able to supply a voltage drop in the shunt resistor 3 to the computation control unit 53 as a digital signal.

That is, first, voltages at the opposite ends of the shunt resistor 3 are input to the computational amplifier 5, and the input voltages are amplified to a proper voltage for input to the analog/digital converter 6 at the next stage, and the amplified voltage is output. The output voltage of the computational amplifier 5 is converted to a digital value by the analog/digital converter 6, and the converted digital value is input to the computation control unit 53.

For example, the computation control unit 53 includes a microcomputer (not illustrated) having a well-known configuration or an ASIC (application specific integrated circuit) as a key component; storage elements (not illustrated) such as a RAM and a ROM; an interface circuit (not illustrated) for outputting a control signal to the energization control semiconductor element 2; and the like as main configurational elements.

The computation control unit 53 executes a drive control process for the glow plug 1, a glow plug diagnosis process (to be described later), and the like.

A target voltage applied to the glow plug 1 corresponding to the status of an engine's operation is input as an instruction in the form of a predetermined signal to the GCU 100 with the aforementioned configuration from an electronic engine control unit (represented by "ECU" in FIG. 1) 200 that is configured to execute a drive control process or fuel injection control process for an engine (not illustrated), and the like.

The electronic engine control unit 200 performs the operation control or fuel injection control for the engine (not illustrated), and computes and calculates a voltage applied to the glow plug 1 corresponding to the status of an engine's operation and instructs the computation control unit 53 about the applied voltage.

The GCU 100 and the electronic engine control unit 200 receive information regarding the setting of a key switch 11 (represented by "KSW" in FIG. 1), that is, information regarding when the key switch 11 is set to an "on" position, and information regarding when the key switch 11 is set to a "start" position.

When the key switch 11 is turned on, the GCU 100 and the electronic engine control unit 200 can be started up by receiving a power supply voltage from the vehicle battery 4 via a path (not illustrated).

There are various techniques in controlling the driving of the glow plug 1; however, when being applied to a glow plug diagnosis method of the embodiment of the present invention, the glow plug drive control technique is not limited to a specific drive control technique, and a proper drive control method can be adopted depending on usage conditions of the apparatus.

Subsequently, in a first example of the embodiment of the present invention, the sequence of a glow plug diagnosis process executed by the computation control unit 53 will be described with reference to FIG. 2.

First, a process illustrated in a subroutine flowchart in FIG. 2 is one subroutine process that is executed by the computation control unit 53, similar to and along with an energization drive control process for the glow plug 1.

The subroutine process illustrated in FIG. 2 is executed when the key switch 11 is turned on.

When the key switch 11 is turned on, and the computation control unit 53 starts the process, similar to a typical driving of the glow plug 1, the start-up energization of the glow plug 1 is started, and a predetermined voltage is applied to the glow plug 1 (refer to step S102 in FIG. 2). The embodiment of the present invention is illustrated based on the assumption that the engine (not illustrated) is not yet started when the key switch 11 is turned on.

Subsequently, the computation control unit 53 determines whether a diagnosis can be performed (refer to step S104 in FIG. 2).

That is, the computation control unit 53 determines whether a predetermined diagnostic condition appropriate for the execution of the following diagnosis process is satisfied.

For example, the predetermined diagnostic condition can be defined as an execution timing. Specifically, the diagnostic condition is preferably defined as whether a predetermined execution timing is reached in which a series of diagnosis procedures have to be executed. More specifically, a determination index such as a vehicle driving time or a vehicle travel distance is preferably used to determine whether the predetermined execution timing is reached.

A diagnosis may be executed whenever a vehicle is driven instead of whenever the vehicle driving time exceeds a predetermined time, or whenever the vehicle travel distance reaches a predetermined travel distance.

For example, the diagnostic condition may be defined as whether engine coolant temperature is in a proper range.

In step S104, when the computation control unit 53 determines that the predetermined diagnostic condition is satisfied (YES), the process proceeds to step S106 (to be described subsequently), and in contrast, when the computation control unit 53 determines that the predetermined diagnostic condition is not satisfied (NO), the computation control unit 53 determines that it is not a proper time to execute a series of subsequent procedures, causes the series of procedures to end and the process to return to a main routine (not illustrated).

In step S106, resistance value gradient data at start-up is acquired.

Figure 5:
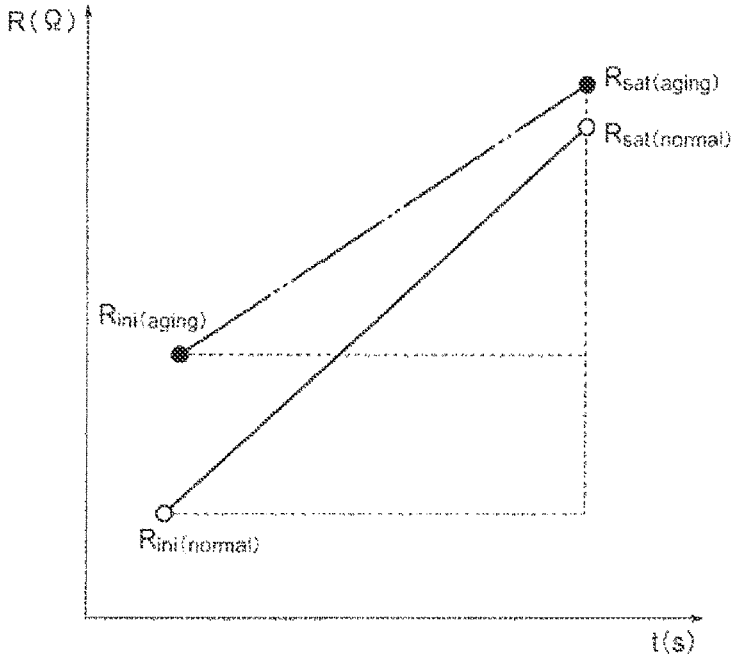
FIG. 5 is a characteristic diagram illustrating a change in the resistance value of a glow plug over time.

Typically, as illustrated by the solid characteristic line in FIG. 5, the resistance value of the glow plug increases approximately over the elapse of time from the start of the energization of the glow plug until the elapse of a predetermined amount of energization time, as known in the related art. In FIG. 5, "Rini" represents the resistance value of the glow plug when the energization of the glow plug is started, and "Rsat" represents the resistance value of the glow plug when a predetermined amount of energization time from the start-up elapses, and a change in the resistance value of the glow plug is stabilized.

The resistance value Rini at the start of the energization of the glow plug is referred to as a so-called ambient temperature resistance value in a sense that heat generation by the glow plug is not sufficient, and the temperature of the glow plug is close to an ambient temperature because the energization of the glow plug is started and then a large amount of time does not elapse.

The resistance value Rsat is a resistance value when the predetermined amount of energization time from the start-up elapses, and a change in the resistance value of the glow plug is stabilized, and in other words, is a resistance value when a change in the resistance of the glow plug due to the heat generation by the glow plug is saturated (in other words, when the heat generation is saturated). In this regard, the resistance value Rsat is referred to as a so-called saturated resistance value.

In FIG. 5, "normal" represents the glow plug that is in a normal state, and "aging" represents the glow that is in an aged state.

In the embodiment of the present invention, when the resistance value Rini and the resistance value Rsat of the glow plug 1 are plotted on a rectangular coordinate system, the horizontal axis of which represents an amount of time elapsed from the start of energization, and the vertical axis of which represents the resistance value, the gradient of a line connecting the two points "Rini" and "Rsat" is defined as a "resistance value gradient", in which the resistance value Rini represents a resistance value when the energization of the glow plug 1 is started, and the resistance value Rsat represents a resistance value when the predetermined amount of energization time from the start of energization elapses, and the resistance value is stabilized.

In place of the aforementioned definition, the "resistance value gradient" may be defined as a value that is calculated in the same aforementioned manner based on the resistance value Rini of the glow plug 1 when the energization of glow plug 1 is started, and the resistance value of the glow plug 1 when the resistance value Rini is acquired and then a predetermined time elapses. In this case, the resistance value of the glow plug 1 at the elapse of the predetermined time is not necessarily a saturated value.

In step S106, first, the resistance value Rini of the glow plug 1 and the resistance value Rsat of the glow plug 1 are computationally calculated based on a drop in the voltage of the shunt resistor 3 which is input via the analog/digital converter 6, in which the resistance value Rini (hereinafter, for descriptive purposes, referred to as an "ambient temperature resistance value") is a resistance value when the start-up energization of the glow plug is started (refer to step S102 in FIG. 2), and the resistance value Rsat (hereinafter, for descriptive purposes, referred to as a "saturated resistance value") is a resistance value when a predetermined amount of energization time elapses.

Since the "elapse of the predetermined amount of energization time" when acquiring the saturated resistance value Rsat is determined as a sufficient amount of time required to obtain the saturated resistance value, the "elapse of the predetermined amount of energization time" is preferably determined based on a test or simulation results while taking specific electrical characteristics of the glow plug 1, a specific voltage applied to the glow plug 1, and the like into consideration.

Accordingly, the resistance value of the glow plug 1 is obtained via a computational process performed in the following manner by the computation control unit 53.

First, a voltage drop in the glow plug 1 is obtained by subtracting a sum of a voltage drop in the shunt resistor 3 and a voltage drop in the energization control semiconductor element 2 from the voltage of the vehicle battery 4. Typically, since an actual voltage of the vehicle battery 4 is acquired in a diagnosis process or the like performed by the electronic engine control unit 200, the acquired voltage data is sufficient enough as the voltage of the vehicle battery 4; however, in place of the actual voltage, a nominal value may be simply used as the voltage of the vehicle battery 4. Since the standard value of a voltage drop in the energization control semiconductor element 2 is also pre-known, the voltage drop may be determined as a constant, and may be used in the aforementioned computational process.

Subsequently, since the amount of the energization current of the glow plug 1 is equivalent to the amount of current flowing through the shunt resistor 3, and the resistance value of the shunt resistor 3 is pre-known, and is stored as a constant in a proper storage region of the computation control unit 53, the amount of the energization current is obtained by dividing an actual measured voltage drop in the shunt resistor 3 by the resistance value of the shunt resistor 3 which is pre-stored as a constant in the computation control unit 53.

The resistance value of the glow plug 1 is obtained by dividing a voltage drop in the glow plug 1 obtained in this manner by the energization current of the glow plug 1.

The ambient temperature resistance value Rini and the saturated resistance value Rsat can be obtained via the aforementioned computation, and the time to actually obtain the ambient temperature resistance value Rini after the energization is started, and the elapsed time thereafter to actually obtain the saturated resistance value Rsat are preferably set based on a test or simulation results while taking the electrical characteristics or a drive control method of and for the glow plug 1 or the like into consideration.

A resistance value gradient at start-up is obtained by dividing a difference between the saturated resistance value Rsat and the ambient temperature resistance value Rini by a time difference between the time for obtaining the ambient temperature resistance value Rini and the time for obtaining the saturated resistance value Rsat, in which the time difference represents a time difference between the time when the computation control unit 53 reads a voltage drop in the shunt resistor 3 so as to calculate the ambient temperature resistance value Rini, and the time when the computation control unit 53 reads a voltage drop in the shunt resistor 3 so as to calculate the saturated resistance value Rsat.

Subsequently, the computation control unit 53 determines whether the resistance value gradient obtained in this manner is a first gradient reference value a or greater (refer to step S108 in FIG. 2), and when the computation control unit 53 determines that the resistance value gradient is the first gradient reference value a or greater (YES), the computation control unit 53 determines that the glow plug 1 is in a normal state (refer to step S110 in FIG. 2), a series of procedures end, and the process returns to the main routine (not illustrated).

Hereinafter, the ground needed for determining the aging of the glow plug 1 based on the resistance value gradient is described.

The resistance value of the glow plug 1 increases over the elapse of time after the energization is started, and the resistance value changes over time, that is, a resistance value gradient occurs, as described above, which is typically well known.

The inventor of this application carries out an in-depth study concerning a relationship between the resistance value gradient and the aging of the glow plug 1 associated with usage, and as a result, the inventor reaches the finding that the ambient temperature resistance value increases as the aging of the glow plug 1 progresses, and thus, the resistance value gradient decreases. For example, in FIG. 5, the solid characteristic line represents an example of the resistance value gradient of the glow plug not used for a large amount of time after the start of use, and the alternate one long and two short dashes characteristic line represents an example of the resistance value gradient of the glow plug that is aged due to long usage, and it can be confirmed that the resistance value gradient decreases further than that in the initial stage of usage.

By virtue of this finding, the inventor of this application reaches a conclusion that it is possible to determine the aging of the glow plug based on the resistance value gradient of the glow plug, and a determination procedure in step S108 is executed based on the results of the study carried out by the inventor of this application.

In step S108, the first gradient reference value a has to be set to a proper value based on a test or simulation results while taking the electrical characteristics of the glow plug 1, operation conditions of the apparatus in use, or the like into consideration.

In contrast, when the computation control unit 53 determines that the resistance value gradient is not the first gradient reference value a or greater in step S108 (NO), the process proceeds to step S112, and the computation control unit 53 determines whether the resistance value gradient is a second gradient reference value b or greater, and is less than the first gradient reference value a.

When the computation control unit 53 determines that the resistance value gradient is the second gradient reference value b or greater, and is less than the first gradient reference value a (YES), the glow plug 1 is considered as being aged to a certain level; however, it is possible to continuously use the glow plug 1 by correcting a voltage applied to the glow plug 1 corresponding to the state of aging, and a correction coefficient for correcting a voltage applied to the glow plug 1 is calculated (refer to step S114 in FIG. 2).

The correction coefficient is computationally calculated using a computational expression that is pre-set based on a test or simulation results, and thus, the correction coefficient can be determined as a proper value corresponding to the resistance value gradient. The computationally calculated correction coefficient is stored in a proper storage region of the electronic engine control unit 200, and is properly supplied to the energization drive control process for the glow plug 1.

Accordingly, the process returns to the main routine (not illustrated) after step S114 is completed.

In contrast, when the computation control unit 53 determines that the resistance value gradient is not in the range from a resistance value gradient greater or equal to the second gradient reference value b to a resistance value gradient less than the first gradient reference value a in step S112 (NO), that is, the resistance value gradient is less than the second gradient reference value b, the resistance value gradient data is stored as resistance value gradient fault data of the glow plug 1 in a proper storage region of each of the computation control unit 53 and the electronic engine control unit 200 (refer to step S116 in FIG. 2).

Simultaneously, a procedure of lighting a predetermined warning lamp (not illustrated) such as a so-called MIL lamp for a fault of the glow plug 1 is executed (step S118 in FIG. 2), a series of procedures end, and the process returns to the main routine (not illustrated).

Subsequently, a second example of the glow plug diagnosis method will be described with reference to FIGS. 3 and 4.

In the second example, it is possible to diagnose the aging of the glow plug 1 by executing a process for a turn on cycle of the key switch 11, and a process for a turn off cycle of the key switch 11, which will be described hereinbelow.

Initially, the sequence of a diagnosis process for the turn on cycle of the key switch 11 will be described with reference to a subroutine flowchart illustrated in FIG. 3.

First, procedures in steps S202 to S214 are basically the same as those in step S102 to S114 illustrated in FIG. 2, therefore the procedures will not be repeatedly described.

When the computation control unit 53 determines that the resistance value gradient is not in the range from a resistance value gradient greater than or equal to the second gradient reference value b to a resistance value gradient less than the first gradient reference value a in step S212 (NO), that is, when the resistance value gradient is less than the second gradient reference value b, the computation control unit 53 determines whether there is a preliminary error determination for the last turn off cycle of the key switch 11 (refer to step S216 in FIG. 3). The preliminary error determination will be described in step S220 (to be described later), and is a provisional determination that the glow plug 1 is faulty.

When the computation control unit 53 determines that there is a preliminary error determination for the last turn off cycle of the key switch 11 in step S216 (YES), the computation control unit 53 confirms that there is an error, that is, that the glow plug 1 is faulty, the computation control unit 53 executes the process of lighting the predetermined warning lamp (not illustrated) such as a so-called MIL lamp (refer to step S218 in FIG. 3), and causes a series of procedures to end, and the process to return to the main routine (not illustrated).

As such, in step S218, the computation control unit 53 confirms that the glow plug 1 is faulty, that is, that there is an error based on the determination that the resistance value gradient is not in the range from a resistance value gradient greater than or equal to the second gradient reference value b to a resistance value gradient less than the first gradient reference value a in step S212, and the determination that there is a preliminary error determination for the last turn off cycle of the key switch 11.

In contrast, when the computation control unit 53 determines that there is no preliminary error determination for the last turn off cycle of the key switch 11 in step S216 (NO), the computation control unit 53 makes a preliminary error determination that the glow plug 1 may be faulty because the determination that the resistance value gradient is not in a range from a resistance value gradient greater than or equal to the second gradient reference value b to a resistance value gradient less than the first gradient reference value a in step S212 is made initially after the last key off cycle of the key switch 11. The occurrence of a preliminary error determination is stored and held in a proper storage region of each of the computation control unit 53 and the electronic engine control unit 200 (refer to step S220 in FIG. 3).

Subsequently, a correction coefficient for correcting a voltage applied to the glow plug 1 is calculated (refer to step S222 in FIG. 3). The correction coefficient is calculated according to the same procedure of calculating a correction coefficient illustrated in step S114 in FIG. 2.

The calculated correction coefficient is stored in a proper storage region of the electronic engine control unit 200, and is used to correct a voltage applied to the glow plug 1 at the next start-up. A series of procedures end, and the process returns to the main routine (not illustrated) after step S222 is completed.

Subsequently, the sequence of a diagnosis process for the turn off cycle of the key switch 11 will be described with reference to a subroutine flowchart illustrated in FIG. 4.

In a state where control of the driving of the engine (not illustrated) is stopped, and an operation diagnosis for a vehicle apparatus is executed, that is, in a so-called after-run state, the process to be described hereinbelow is executed when the key switch 11 is turned off as described below.

When the key switch 11 is turned off, and the process executed by the computation control unit 53 is started, the test energization of the glow plug 1 is performed (refer to step S302 in FIG. 4).

The test energization is performed in place of the start-up energization (step S102 in FIG. 2) in the first example illustrated in FIG. 2 so as to obtain the resistance value of the glow plug 1 after energized, and is performed at a proper predetermined voltage applied to the glow plug 1 for a properly predetermined energization time. Specifically, the proper applied voltage and energization time is preferably determined based on a test or simulation results while taking the specification of the glow plug 1 or the entire apparatus, or the like into consideration.

Subsequently, the resistance value of the glow plug 1 is acquired when the test energization is completed (refer to step S304 in FIG. 4). Since the resistance value of the glow plug 1 is acquired according to the same procedure illustrated in step S106 of the first example with reference to FIG. 2, the procedure will not be repeatedly described.

Subsequently, when the computation control unit 53 determines whether the acquired resistance value of the glow plug 1 is a first reference resistance value c or less (refer to step S306 in FIG. 4), and determines that the resistance value of the glow plug 1 is the first reference resistance value c or less (YES), the computation control unit 53 determines that the glow plug 1 is normal (refer to step S308 in FIG. 4), and causes a series of procedures to end, and the process to return to the main routine (not illustrated).

The results of study (to be described hereinbelow) carried out by the inventor of this application are the basis for determining that the glow plug 1 is normal when the resistance value of the glow plug 1 is the first reference resistance value c or less.

First, the inventor of this application carries out an in-depth study concerning a change in the resistance value after the key switch 11 is turned off, and as a result, the inventor reaches the finding that the resistance value after the turning off of the key switch 11 increases as the operating time and operating years of the glow plug 1 increase.

Figure 6:
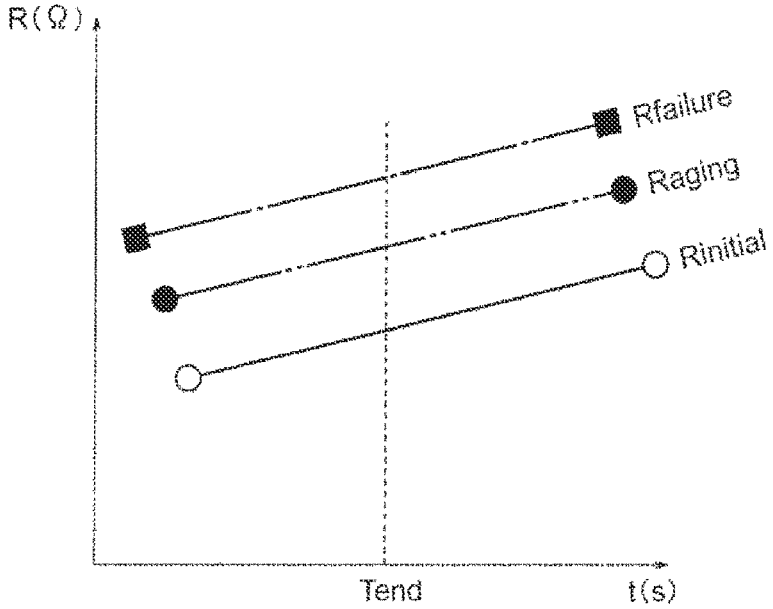
FIG. 6 is a characteristic diagram illustrating a change in the resistance value over time after the key switch is turned off.

FIG. 6 illustrates an example of a change in the resistance value of the glow plug when the test energization of the glow plug is performed after the key switch 11 is turned off, and in regard to a description of FIG. 6, first, the horizontal axis represents an amount of time elapsed after the key switch 11 is turned off, and the vertical axis represents the resistance value of the glow plug.

In FIG. 6, the solid characteristic line represents characteristics of a resistance value change when the glow plug is not used for a large amount of time after the start of use, the alternate one long and two short dashes characteristic line represents characteristics of a resistance value change when the glow plug is aged, and the alternate long and short dash characteristic line represents characteristics of a resistance value change when the aging of the glow plug further progresses, and the glow plug is determined to be in a state of malfunction.

It is possible to confirm that the resistance value increases as the aging of the glow plug progresses, based on these characteristic lines.

By virtue of this finding, the inventor of this application reaches a conclusion that it is possible to determine the aging of the glow plug based on the resistance value of the glow plug at a proper time Tend (refer to FIG. 6) after the key switch 11 is turned off, and a determination procedure in step S306 is executed based on the results of the study carried out by the inventor of this application.

In contrast, when the computation control unit 53 determines that the resistance value of the glow plug 1 is not the first reference resistance value c or less in step S306 (NO), the computation control unit 53 determines whether the resistance value of the glow plug 1 exceeds the first reference resistance value c, and is a second reference resistance value d or less (refer to step S310 in FIG. 4).

When the computation control unit 53 determines that the resistance value of the glow plug 1 is in a range from a resistance value exceeding the first reference resistance value c to a resistance value less than or equal to the second reference resistance value d in step S310 (YES), the glow plug 1 is considered as being aged to a certain level; however, it is possible to continuously use the glow plug 1 by correcting a voltage applied to the glow plug 1 corresponding to the state of aging, and a correction coefficient for correcting a voltage applied to the glow plug 1 is calculated (refer to step S312 in FIG. 4).

The correction coefficient is computationally calculated using a computational expression that is pre-set based on a test or simulation results, and thus, the correction coefficient can be determined as a proper value corresponding to the acquired resistance value of the glow plug 1. The computationally calculated correction coefficient is stored in a proper storage region of the electronic engine control unit 200, and is properly supplied to the energization drive control process for the glow plug 1.

In contrast, when the computation control unit 53 determines that the resistance value of the glow plug 1 is not in the range from a resistance value exceeding the first reference resistance value c to a resistance value less than or equal to the second reference resistance value d in step S310 (NO), that is, the resistance value of the glow plug 1 exceeds the second reference resistance value d, the computation control unit 53 determines whether there is a preliminary error determination for the last turn on cycle of the key switch 11 (refer to step S314 in FIG. 4).

When the computation control unit 53 determines that there is a preliminary error determination for the last turn on cycle of the key switch 11 in step S314 (YES), the computation control unit 53 confirms that there is an error, that is, that the glow plug 1 is faulty, the computation control unit 53 schedules a warning operation to be performed in the next turn on cycle of the key switch 11 (refer to step S316 in FIG. 4), and causes a series of procedures to end, and the process to return to the main routine (not illustrated).

That is, a predetermined command or the like is stored in a proper non-volatile storage region in the storage region of the computation control unit 53 so that the warning operation is executed in the next turn on cycle of the key switch 11, that is, the warning operation is scheduled to be performed. The command or the like is decoded in the next turn on cycle of the key switch 11 to perform the warning operation.

The warning operation represents the process of lighting the predetermined warning lamp (not illustrated) such as a so-called MIL lamp; however, the present invention is not limited to the aforementioned type of the warning operation, and in place of lighting the warning lamp, or along with the lighting of the warning lamp, a user is preferably notified of the error using a warning sound or a human voice.

In contrast, when the computation control unit 53 determines that there is no preliminary error determination for the last turn on cycle of the key switch 11 in step S314 (NO), the computation control unit 53 makes a preliminary error determination that the glow plug 1 may be faulty because the determination that the resistance value of the glow plug 1 is not in the range from a resistance value exceeding the first reference resistance value c to a resistance value less than or equal to the second reference resistance value d in step S310 is made initially after the last turn on cycle of the key switch 11. The occurrence of a preliminary error determination is stored and held in a proper storage region of each of the computation control unit 53 and the electronic engine control unit 200 (refer to step S318 in FIG. 4).

As such, in the second example, since the diagnosis process for each of the turn on and turn off cycles of the key switch 11 is executed, it is possible to more reliably ensure an improvement in the reliability and certainty of the diagnosis process for the glow plug.

The present invention can be applied to a vehicle that requires a highly reliable diagnosis of the aging of a glow plug.

The invention claimed is:

1. A glow plug diagnosis method comprising:

energizing a glow plug in a predetermined manner when a key switch of a vehicle is turned on;

measuring a resistance value of the glow plug when the energization of the glow plug is started, and a resistance value of the glow plug a predetermined time after the energization of the glow plug is started, and calculating a change in the resistance value over time as a resistance value gradient;

determining that the glow plug is normal when the resistance value gradient exceeds a predetermined first gradient reference value; and wherein when the resistance value gradient is less than a predetermined second gradient reference value, it is determined whether a preliminary error determination for a last turn off cycle of the key switch is stored, and when it is determined that the preliminary error determination is not stored, the occurrence of a preliminary error determination is stored, and when it is determined that the preliminary error determination is stored, it is determined that the glow plug is faulty, and wherein when the preliminary error determination is stored, and then the key switch is turned off, a test energization of the glow plug is performed in a predetermined manner, and when the energization is completed, a resistance value of the glow plug is measured, and when the resistance value is the first reference resistance value or less, it is determined that the glow plug is normal.

2. The glow plug diagnosis method according to claim 1, further comprising determining the glow plug is faulty when the resistance value gradient is less than a predetermined second gradient reference value.

3. The glow plug diagnosis method according to claim 2, wherein when the resistance value gradient is in a range from a resistance value gradient greater than or equal to the predetermined second gradient reference value to a resistance value gradient less than the first gradient reference value, a correction coefficient for a voltage applied to the glow plug when energized is calculated based on a difference between the resistance value gradient and a pre-acquired resistance value gradient of the glow plug in a normal state, and the applied voltage is corrected with the correction coefficient.

4. The glow plug diagnosis method according to claim 1, wherein when the resistance value of the glow plug at the completion of the test energization in a turn-off state of the key switch exceeds the second reference resistance value, it is determined whether a preliminary error determination for the last turn on cycle of the key switch is stored, and when it is determined that the preliminary error determination is not stored, the occurrence of a preliminary error determination is stored, and when it is determined that the preliminary error determination is stored, it is determined that the glow plug is faulty, and a warning operation is scheduled so that the warning operation can be performed at the next turn on cycle of the key switch.

5. The glow plug diagnosis method according to claim 4, wherein when the resistance value of the glow plug is in a range from a resistance value exceeding the first reference resistance value to a resistance value less than or equal to the second reference resistance value, a correction coefficient for a voltage applied to the glow plug when energized is calculated based on a difference between the resistance value and a pre-acquired resistance value of the glow plug in a normal state, and the applied voltage is corrected with the correction coefficient.

6. A vehicle glow plug drive control apparatus comprising:

a computation control unit configured to control the driving of a glow plug; and an energization drive circuit configured to energize the glow plug in response to the control of the driving of the glow plug executed by the computation control unit, wherein when a key switch of a vehicle is turned on, the computation control unit energizes the glow plug in a predetermined manner, calculates a resistance value of the glow plug when the energization of the glow plug is started, and a resistance value of the glow plug a predetermined time after the energization of the glow plug is started, based on a voltage applied to the glow plug and energization current of the glow plug, and calculates a change in the resistance value over time as a resistance value gradient based on the calculated resistance values, and when the resistance value gradient exceeds a predetermined first gradient reference value, the computation control unit determines that the glow plug is normal; and wherein when the resistance value gradient is less than a predetermined second gradient reference value, the computation control unit determines whether a preliminary error determination for a last turn off cycle of the key switch is stored, and when the computation control unit determines that the preliminary error determination is not stored, the computation control unit stores the occurrence of a preliminary error determination, and when the computation control unit determines that the preliminary error determination is stored, the computation control unit determines that the glow plug is faulty, and wherein when the preliminary error determination is stored, and then the key switch is turned off, the computation control unit performs a test energization of the glow plug in a predetermined manner, and when the energization is completed, the computation control unit measures the resistance value of the glow plug, and when the resistance value is the first reference resistance value or less, the computation control unit determines that the glow plug is normal.

7. The vehicle glow plug drive control apparatus according to claim 6, wherein when the resistance value gradient is less than a predetermined second gradient reference value, the computation control unit determines that the glow plug is faulty.

8. The vehicle glow plug drive control apparatus according to claim 7, wherein when the resistance value gradient is in a range from a resistance value gradient greater than or equal to the predetermined second gradient reference value to a resistance value gradient less than the first gradient reference value, the computation control unit calculates a correction coefficient for a voltage applied to the glow plug when energized, based on a difference between the resistance value gradient and a pre-acquired resistance value gradient of the glow plug in a normal state, and corrects the applied voltage with the correction coefficient.

9. The vehicle glow plug drive control apparatus according to claim 6, wherein when the resistance value of the glow plug at the completion of the test energization in a turn-off state of the key switch exceeds the second reference resistance value, the computation control unit determines whether a preliminary error determination for the last turn on cycle of the key switch is stored, and when the computation control unit determines that the preliminary error determination is not stored, the computation control unit stores the occurrence of a preliminary error determination, and when the computation control unit determines that the preliminary error determination is stored, the computation control unit determines that the glow plug is faulty, and schedules a warning operation so that the warning operation can be performed at the next turn on cycle of the key switch.

10. The vehicle glow plug drive control apparatus according to claim 9, wherein when the resistance value of the glow plug is in a range from a resistance value exceeding the first reference resistance value to a resistance value less than or equal to the second reference resistance value, the computation control unit calculates a correction coefficient for a voltage applied to the glow plug when energized, based on a difference between the resistance value and a pre-acquired resistance value of the glow plug in a normal state, and the computation control unit corrects the applied voltage with the correction coefficient.

11. A glow plug diagnosis method comprising:

energizing a glow plug in a predetermined manner when a key switch of a vehicle is turned on;

measuring a resistance value of the glow plug when the energization of the glow plug is started, and a resistance value of the glow plug a predetermined time after the energization of the glow plug is started, and calculating a change in the resistance value over time as a resistance value gradient;

determining that the glow plug is normal when the resistance value gradient exceeds a predetermined first gradient reference value; and determining the glow plug is faulty when the resistance value gradient is less than a predetermined second gradient reference value;

wherein when the resistance value gradient is in a range from a resistance value gradient greater than or equal to the predetermined second gradient reference value to a resistance value gradient less than the first gradient reference value, a correction coefficient for a voltage applied to the glow plug when energized is calculated based on a difference between the resistance value gradient and a pre-acquired resistance value gradient of the glow plug in a normal state, and the applied voltage is corrected with the correction coefficient.

12. A vehicle glow plug drive control apparatus comprising:

a computation control unit configured to control the driving of a glow plug; and an energization drive circuit configured to energize the glow plug in response to the control of the driving of the glow plug executed by the computation control unit, wherein when a key switch of a vehicle is turned on, the computation control unit energizes the glow plug in a predetermined manner, calculates a resistance value of the glow plug when the energization of the glow plug is started, and a resistance value of the glow plug a predetermined time after the energization of the glow plug is started, based on a voltage applied to the glow plug and energization current of the glow plug, and calculates a change in the resistance value over time as a resistance value gradient based on the calculated resistance values, and when the resistance value gradient exceeds a predetermined first gradient reference value, the computation control unit determines that the glow plug is normal;

wherein when the resistance value gradient is less than a predetermined second gradient reference value, the computation control unit determines that the glow plug is faulty; and wherein when the resistance value gradient is in a range from a resistance value gradient greater than or equal to the predetermined second gradient reference value to a resistance value gradient less than the first gradient reference value, the computation control unit calculates a correction coefficient for a voltage applied to the glow plug when energized, based on a difference between the resistance value gradient and a pre-acquired resistance value gradient of the glow plug in a normal state, and corrects the applied voltage with the correction coefficient.

* * * * *